United States Patent [19]

Cooper

[11] 4,333,253

[45] Jun. 8, 1982

[54] DISPLAY SIGN

[76] Inventor: Andrew K. Cooper, 22635 Flamingo St., Woodland Hills, Calif. 91364

[21] Appl. No.: 106,447

[22] Filed: Dec. 26, 1979

[51] Int. Cl.[3] ..... G09F 3/18

[52] U.S. Cl. ..... 40/10 R; 40/152

[58] Field of Search ..... 40/10 R, 594, 152

[56] References Cited

U.S. PATENT DOCUMENTS

| | | | |
|---|---|---|---|
| 1,935,737 | 11/1933 | Christ | 40/10 R |
| 2,598,755 | 6/1952 | Birch | 40/158 R |
| 2,632,269 | 3/1953 | Sanders | 40/594 |
| 2,634,529 | 4/1953 | Burdick | 40/594 |
| 2,785,490 | 3/1957 | Fabry | 40/152 |
| 3,786,584 | 1/1974 | Holson | 40/158 R |
| 3,873,342 | 3/1975 | Ellison | 40/158 R |
| 3,885,336 | 5/1975 | Olsen | 40/152 |
| 3,928,921 | 12/1975 | Gurman | 40/621 |
| 4,040,194 | 8/1977 | Penton et al. | 40/621 |

*Primary Examiner*—Gene Mancene
*Assistant Examiner*—Wenceslao J. Contreras
*Attorney, Agent, or Firm*—Roger A. Marrs

[57] ABSTRACT

A display sign is disclosed herein having a dual feature back member or frame formed in a singular piece with a continuous sidewall having precise contoured corners that flow into the perimeter edge in an uninterrupted seamless line extending outwardly from the edge marginal peripheral region of a flat plate. An area defined by the opposite surfaces of the sidewall and the adjacent surface of the back member defines a recessed mounting area for removably receiving a front flat plate so that the area is substantially occupied by the volume thereof. The dimension of the flat plate is less than the space it is occupying so that a deep channel or groove is established between the edge of the plate and the opposing surface of the continuous sidewall so that a continuous channel or reval plate which is of different color or texture than the color or texture of either the back member or the plate so that a visual distinction or difference exists therebetween. Suitable indicia is carried on a front face or surface of the plate or on the reverse surface of the back member for display purposes.

1 Claim, 7 Drawing Figures

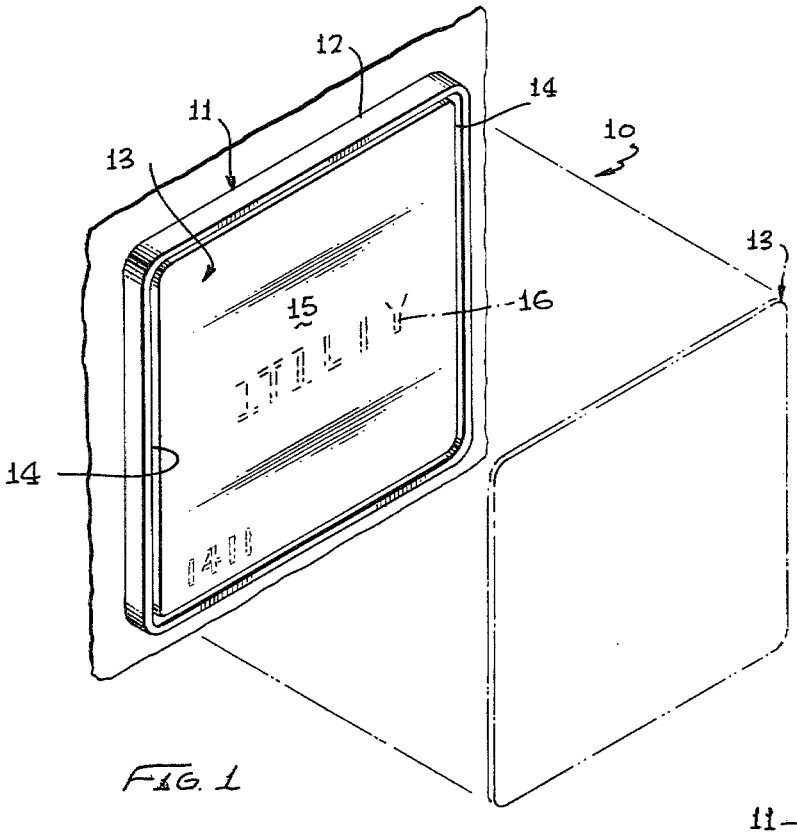
FIG. 1
FIG. 4
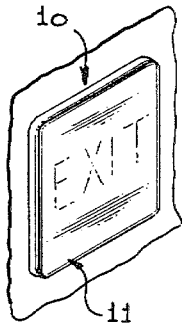
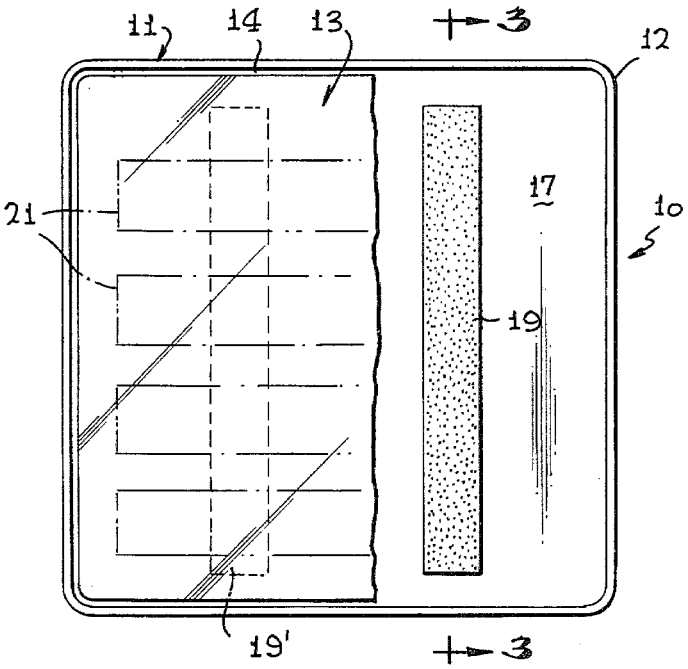
FIG. 2
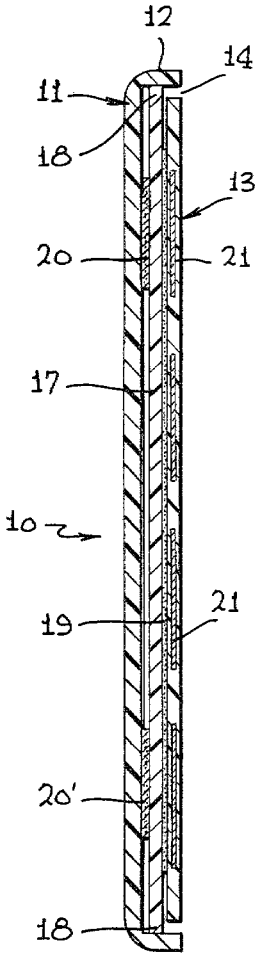
FIG. 3

FIG. 5
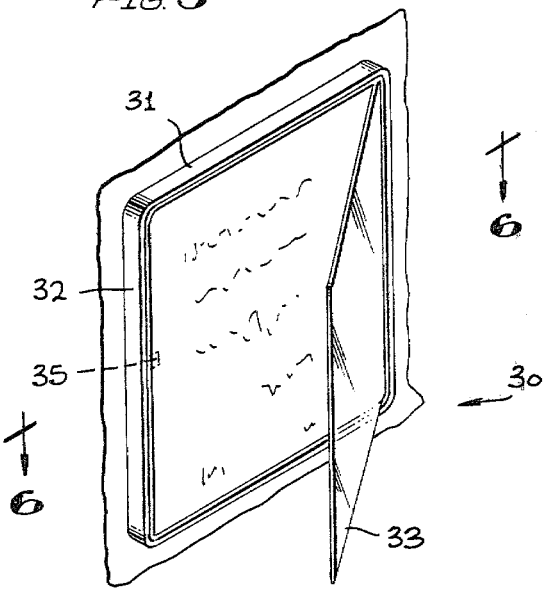
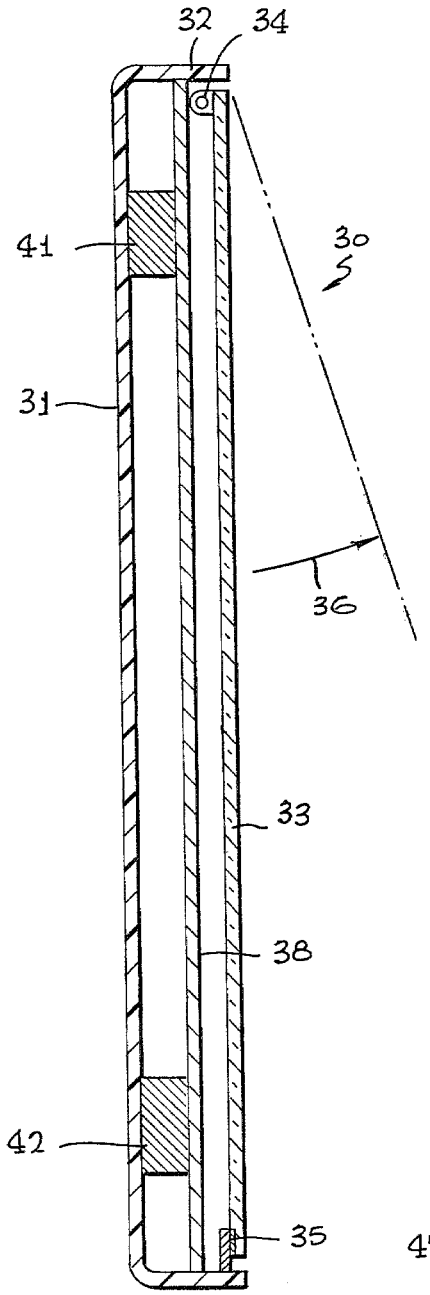
FIG. 6
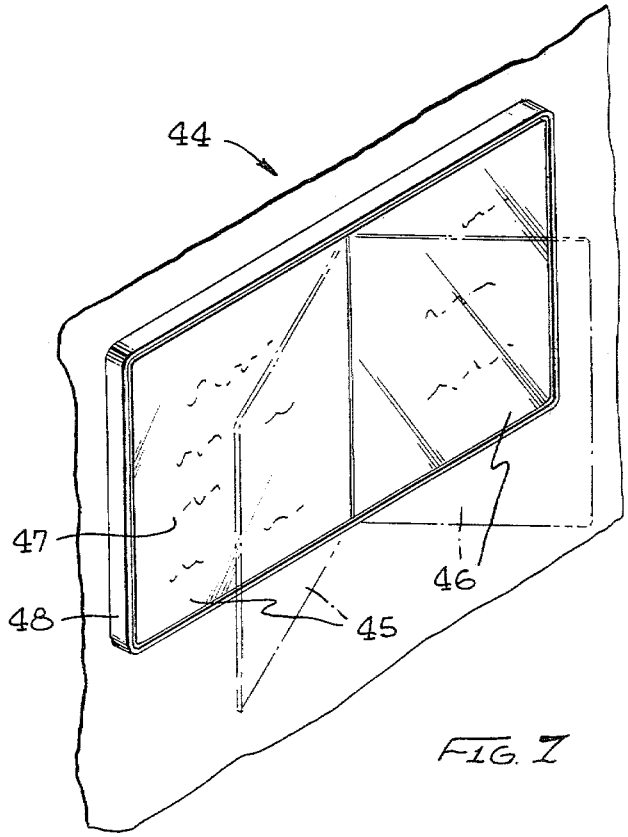
FIG. 7

DISPLAY SIGN

BACKGROUND OF THE INVENTION

1. Field of the Invention

The present invention relates to a novel display sign with it's unique dual feature back member or frame consisting of a singularly molded unit with precise contour corners and sidewalls and more particularly to a novel display sign wherein the front cavity of the back member can house a removable plate of other feature for selectively carrying a variety of messages, slogans or indicia; or the frame in it's reverse position can carry the suitable indicia displayed on the back member's surface.

2. Brief Description of the Prior Art

In the past, it has been the conventional practice to form the back with square corners using extruded metal angle sandwiched between two pieces of material such as masonite. The front plate is then inserted as appropriate which carries the indicia. Difficulties and problems have been encountered when employing this system to form the back which requires many manual manufacturing and assembly steps or procedures.

Therefore, a long standing need has existed to provide a novel display sign which may be readily changes with respect to its message or indicia; which is relatively simple to manufacture and conforms with the present and future state of the art in design, which design can be applied to a total display requirement presenting an established standard for uniformity.

SUMMARY OF THE INVENTION

Accordingly, the above problems and difficulties are obviated by the present invention which provides a novel display sign having a singular dual function back member formed with a continuous sidewall extending completely around its peripheral edge so as to define a display area between its opposing surfaces. For one side a flat plate is provided which substantially occupies the display area except for a briefly defined channel or reveal existing between the opposing edge of the plate at the sidewall. The channel is continuous and the height of the sidewall is no higher than the front surface of the plate while occupied in the display area. The flat plate includes a display area and its front face which supports predetermined indicia. A reveal plate or liner is disposed between the edge marginal region of the flat plate and the back member. The liner is of substantially different color or texture than the surrounding sidewall and flat plate so that a visual distinction is produced. Adhesive means are provided for releasably securing the display plate to the back member. On the other side the message or indicia can be placed on the surface providing a distinctive functional design.

Therefore, it is among the primary objects of the present invention to provide a functional novel display sign having distinctive physical and visual characteristics that can be used for a total integrated signage requirement for any type facility.

Another object of the present invention is to provide a novel display sign which is of relatively low cost to manufacture and produce as well as to assemble and use.

Yet another object of the present invention is to provide a single back member or frame which presents two unique functional designs, front and reverse side, that are in consonance with the present and future state of the art in design.

A further object of the present invention is to provide a novel display sign having a back member which adhesively supports a display plate so that a reveal is present between the edge of the display plate and the perimeter of the backing member so as to provide a visual distinction therebetween.

Another object of the present invention resides in a novel display plaque presenting the pleasing softness of precisely contoured corners that flow into the perimeter edge thereof in an uninterrupted seamless line.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a front perspective view of the novel display sign or plaque incorporating features of the present invention:

FIG. 2 is a front elevational view, partly in fragmentary section, of the display sign shown in FIG. 1;

FIG. 3 is a transverse cross-sectional view of the display sign taken in the direction of arrows 3—3 of FIG. 2.

FIG. 4 is a rear perspective view of the inventive display illustrating a display surface available for carrying indicia;

FIG. 5 is a perspective view of another embodiment of the invention illustrating the invention in use as a wall directory;

FIG. 6 is a transverse cross sectional view of the display sign or directory as taken in the direction of arrows 6—6 of FIGURE; and FIG. 7 is a view similar to the view of FIG. 5 showing a double display unit.

DESCRIPTION OF THE PREFERRED EMBODIMENT

Referring to FIG. 1, the novel display sign or plaque of the present invention is indicated in the general direction of arrow 10 which includes a back member or frame 11 having a continuous sidewall 12 extending about the periphery of the back member or frame 11. Between the opposing wall surfaces of the sidewall 12, there is provided a display area which is substantially occupied by a flat display plate or sign insert indicated by numeral 13. The outside dimension of the flat plate or insert 13 is substantially smaller or reduced with respect to the distance between the opposing surfaces of the sidewall 12 defining the display area so that a continuous open channel 14 is defined between the edge of the plate or insert 13 and the opposing wall surface of sidewall 12. The flat plate or insert 13 includes a display area on its front surface identified by numeral 15 which carries predetermined indicia such as the letters indicated by numeral 16.

Disposed between the backing member 11 and plate or insert 13, there is provided a filler member 17, shown more clearly in FIG. 2, which includes an edge marginal region 18 exposed through the channel 14. Preferably, the filler member 17 is of a contrasting color or texture to the color or texture of the display plate or insert 13 so that a definite visual distinction results.

As will be described later, the flat plate 13 carrying the sign, letter, number or other information thereon is readily removable and as shown in broken lines the flat plate 13 is removed from the display area as defined between the opposing wall surfaces of the sidewall 12.

Referring now in detail to FIG. 2, it can be seen that the display plate on sign insert 13 is removably secured or detachably mounted on the surface of the filler member 17 by a pair of strips of adhesive material identified by numerals 19 and 19'. The strips are of the double-backed adhesive type and it is important to note that the material does not extend beyond the edge of the flat plate 13 so that only edge marginal region 18 is visably observed between the wall surface of the sidewall 12 and the edge of the plate 13. As noted, region 18 is of a different color or texture from the color or texture of both the sidewall 12 and flat plate 13 so that the visual distinction is more pronounced.

The rear surface of the filler member 17 is provided with similar adhesive strips such as strips 20 and 20' shown in FIG. 3.

The indicia carried on the display plate 13 may be imprinted, painted, glued or otherwise applied to the display surface 15 thereof as shown in FIG. 1 or the plate 13 may be provided with display strips 21 that are selectively inserted into suitable receptacles. However, this latter structure is not a part of the subject invention.

Referring now in detail to FIG. 3, it can be seen that the groove or gap 14 provides a reveal which exposes the peripheral or edge marginal region 18 of the filler member 17 so that its presence is visually noticeable. A striking effect is visually presented when the color or texture of the region 18 is different from the color or texture of the surrounding material of wall 12 and plate 13.

Referring to FIG. 4, the display sign or plaque 10 is illustrated in its reverse position from the position shown in FIG. 1. In this position, the back member 11 exposes a rear surface on which suitable indicia can be carried and displayed. The sign or plaque may be mounted on a vertical wall by foam tape or screws affixed to mounting blocks in the cavity of the plaque. Therefore, it can be seen that the sign or plaque can be used as shown in FIG. 1 with the indicia carried on surface 15 so that the message is bordered by the groove 14 and the reveal provided thereon or the sign may be reversed to expose the backside which is useful in carrying a message without the reveal being present. In either instance of use or position, the sign presents a continuous sidewall extending outwardly from the edge marginal peripheral region of the backmember which of molded construction having rounded corners and which is completely seamless.

Referring now in detail to FIGS. 5–7 inclusive, another embodiment of the present invention is illustrated and is shown in the general direction of arrow 30. The embodiment illustrated is in the form of a directory having a backmember 31 substantially similar to the backmember 11 shown in the embodiments of FIGS. 1–4 inclusive. The backmember 31 includes a continuous, seamless sidewall 32 which is molded, with a flat plate so that a display area is defined between the opposing surfaces of the continuous surfaces of sidewall 32. Located within the display area, there is provided a glass door 33 mounted at one end on a pivot hinge at its top and bottom as indicated by numeral 34. On its edge opposite from its edge carrying the hinges 34, there is provided a magnetic catch or keylock indicated by numeral 35. When it is desired to have access to the display area, the glass door 33 is pivoted on the hinges in the direction on arrow 36. Disposed immediately behind the door 33, there is provided a vertical channel rack 38, for holding a plurality of removable strips carrying the names and locations of occupants in a public or private building. As an alternate a horizontally grooved board to hold individual insertable letters or standard cork board insert bulletin board can be used in lieu of the strip rack. The vertical rack, insertable letter board or cork bulletin board, 38, is suitably carried on insert mounting blocks indicated by numerals 41 and 42 respectively.

Referring now in detail to FIG. 7, a similar directory is illustrated in the general direction of arrow 44; however, double glass doors are provided as indicated above by numeral 45 and 46. The doors may pivot from the center as indicated or pivot hinges may be provided in the respective corners and the doors may separate at the center and pivot outwardly. The indicia strips or board is indicated by numeral 47 while the sidewall 48 is carried on a backmember identical to the backmember described with respect to the previous versions.

From the foregoing, it can be seen that the novel display sign or plaque of the present invention is light in weight and requires a minimum of assembly steps or procedures. Specifically, the backmember or frame of each version is molded as well as the other component parts as the indicia strips, flat plates or the like. The backmember may be readily secured to a wall surface such by concealed screws, nails or adhesive materials. The present invention by implying a molded backmember provides a pleasing softness of precisely contoured corners that flow into the perimeter edge in an uninterrupted seamless line.

While particular embodiments of the present invention have been shown and described, it will be obvious to those skilled in the art that changes and modifications may be made without departing from this invention in its aspects and, therefore, the aim in the appended claims is to cover all such changes and modifications as fall within the true spirit and scope of this invention.

What is claimed is:

1. A display sign for mounting on a vertical wall comprising the combination of:

a single black member or frame providing a rear element or front face carrying a continuous, seamless sidewall about its peripheral edge so as to define a central display area between the opposing wall surfaces of said continuous sidewall;

a display plate substantially occupying said recessed display area;

the peripheral edge of said display plate and the opposing wall surfaces of said continuous sidewall defining a continuous and uninterrupted groove therebetween defining a reveal;

a filler plate occupying said central display recessed area immediately behind said display plate and having edge marginal regions exposed via said reveal;

adhesive means attaching said display plate to said filler plate and said filler plate to said back member;

said display plate having an exposed face or surface surrounded by said reveal carrying indicia for visual observation;

the reverse side of the back member or frame whose surface provides a display area for carrying indicia for visual observation;

said display plate and said back member are molded parts of plastic material;

said marginal region of said filler plate terminates immediately adjacent to and in insertable contact with said continuous sidewall;

said adhesive strips spaces said display plate from said filler plate and said filler plate from said rear element of said back member so as to define a closed cavity therebetween providing lightening characteristics;

said continuous sidewall is integrally formed with said rear element of said back member so as to provide contoured corners that flow into the perimeter edge in an uninterrupted seamless line;

a glass door pivotally mounted on said back member sidewall.

* * * * *